United States Patent [19]

Mizota et al.

[11] Patent Number: 4,773,302

[45] Date of Patent: Sep. 27, 1988

[54] CONTROL APPARATUS AND PROPORTIONAL SOLENOID VALVE CONTROL CIRCUIT FOR BOOM-EQUIPPED WORKING IMPLEMENT

[75] Inventors: Hideaki Mizota; Eriya Harada, both of Osaka, Japan

[73] Assignee: Kubota, Ltd., Osaka, Japan

[21] Appl. No.: 13,954

[22] Filed: Feb. 12, 1987

[30] Foreign Application Priority Data

Feb. 12, 1986 [JP] Japan ..... 61-29667
Feb. 13, 1986 [JP] Japan ..... 61-30222
Apr. 15, 1986 [JP] Japan ..... 61-87338

[51] Int. Cl.[4] ..... F15B 13/16

[52] U.S. Cl. ..... 91/361; 91/459; 414/700; 414/708

[58] Field of Search ..... 91/361, 362, 363 R, 91/459, 429, 275; 414/708, 700, 686

[56] References Cited

U.S. PATENT DOCUMENTS 3,430,536 3/1969 Oelrich ..... 91/47
3,739,813 6/1973 Worden ..... 91/459 X
3,844,378 10/1974 Balogh ..... 91/459 X
4,266,909 5/1981 Langenfeld et al. ..... 414/708 X
4,587,883 5/1986 Ehrentraut et al. ..... 91/361 X
4,625,622 12/1986 Gunda et al. ..... 91/361 X
4,643,074 2/1987 Gunda et al. ..... 91/361

*Primary Examiner*—Edward K. Look
*Attorney, Agent, or Firm*—Birch, Stewart, Kolasch & Birch

[57] ABSTRACT

A control apparatus having a boom control system for controlling the movement of a liftable boom supported by a vehicle body and a working device control system for controlling a working device pivoted to the boom. Each of the control system includes a proportional solenoid valve and comprises an instruction circuit for producing an instruction signal in accordance with the amount of manipulation of an operating lever, discriminating circuit for determining the direction of operation of the valve from the instruction signal, a reference signal generator, a comparison circuit for comparing the instruction signal with the reference signal from the generator to obtain a pulse signal of a width in proportion to the amount of manipulation, and drive circuit for converting the pulse signal into a current to drive the valve in the direction determined by the discriminating circuit. The boom, as well as the working device, is movable at a speed corresponding to the amount of manipulation of the operating lever.

18 Claims, 12 Drawing Sheets

1
2
3
4
5
6
7
8
9
10
11
12
13
14
15
16
17
18
19
20
21
22
23
23a
24
25
26
32
38
72
73
77
78

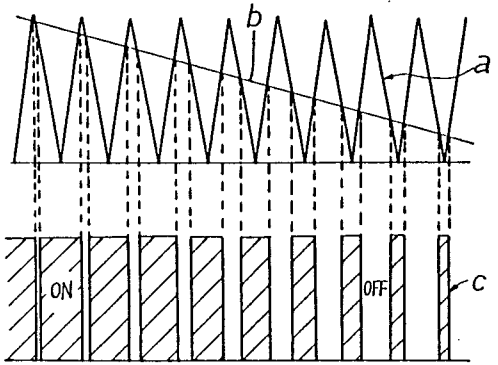
Fig 9
| | | | |
|---|---|---|---|
| SCOOPING DOWN | DOWN | STOP | DUMPING DOWN |
| SCOOPING | | | DUMPING |
| SCOOPING UP | UP | | DUMPING UP |
Fig 10
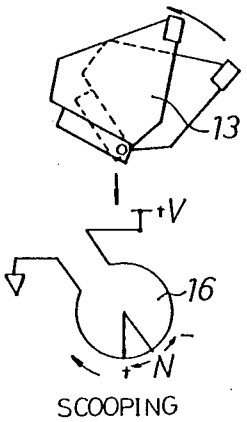
Fig.11(I)
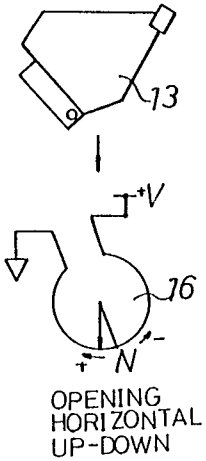
Fig.11(II)
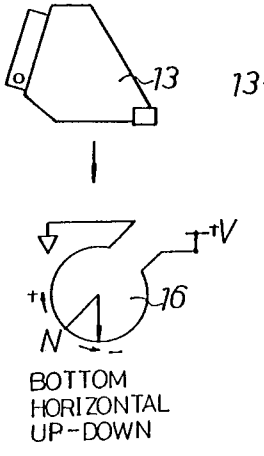
Fig.11(III)
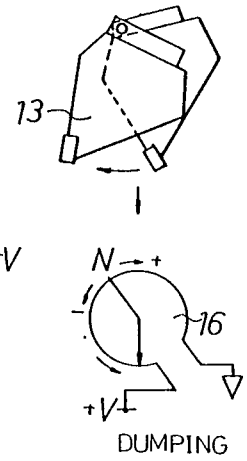
Fig.11(IV)

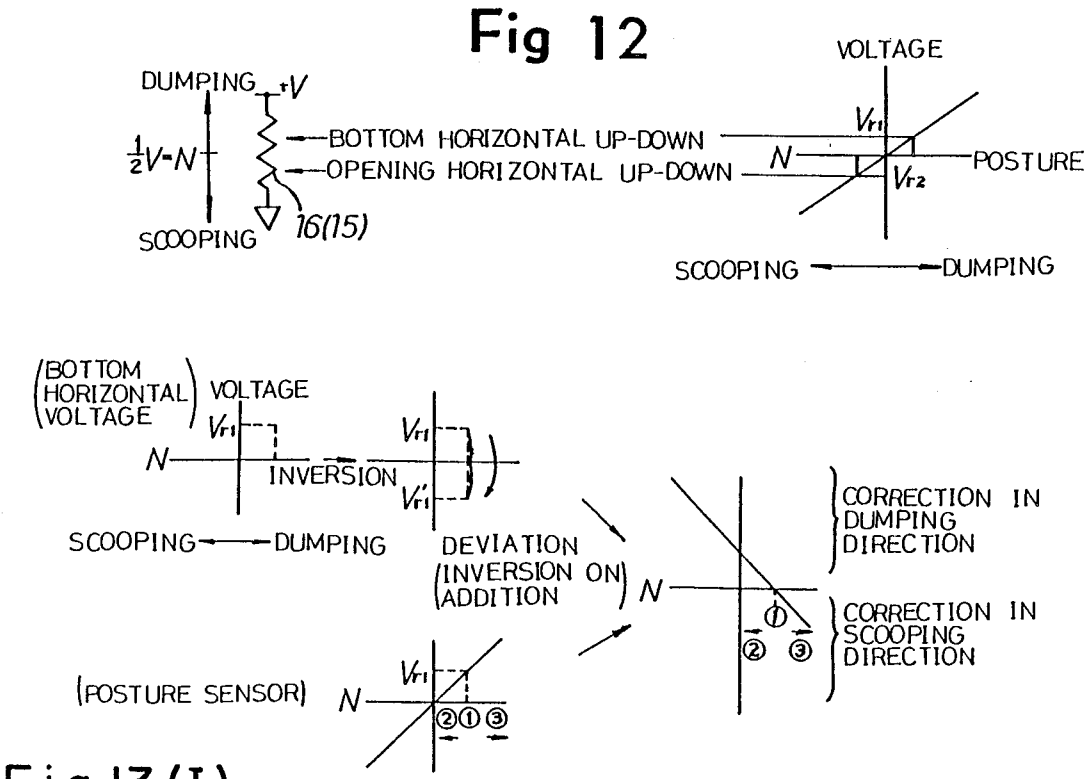
Fig 12
VOLTAGE
POSTURE
DUMPING
+V
BOTTOM HORIZONTAL UP-DOWN
OPENING HORIZONTAL UP-DOWN
16(15)
SCOOPING
DUMPING
SCOOPING
(BOTTOM HORIZONTAL VOLTAGE)
VOLTAGE
INVERSION
SCOOPING
DUMPING
DEVIATION (INVERSION ON) (ADDITION)
CORRECTION IN DUMPING DIRECTION
CORRECTION IN SCOOPING DIRECTION
(POSTURE SENSOR)
Fig.13(I)
FIG. 13(II)
FIG. 13(III)

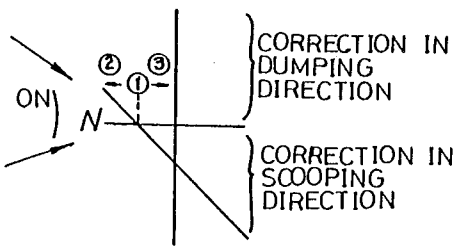
FIG.14(III)

CONTROL APPARATUS AND PROPORTIONAL SOLENOID VALVE CONTROL CIRCUIT FOR BOOM-EQUIPPED WORKING IMPLEMENT

FIELD OF THE INVENTION AND RELATED ART STATEMENT

The present invention relates to a control apparatus and a proportional solenoid valve control circuit for boom-equipped working implements.

Working implements comprising a boom assembly liftably pivoted to a vehicle body and working means pivotably connected to the forward end of the boom assembly include a tractor-attached front loader and various other implements.

The tractor-attached front loader comprises a pair of opposite booms liftably pivoted to the body of the tractor, and a bucket pivotably connected to the forward end of each boom. A hydraulic circuit for a boom cylinder and a bucket cylinder for operating the boom where the bucket has solenoid valves in corresponding relation to these cylinders for controlling the upward or downward movement of the boom and the rotation of the bucket in a scooping or dumping direction.

The control system for such a working implement generally has an operating lever which is moved forward or rearward or sideward to operate a switch, which in turn energizes or deenergizes the corresponding solenoid valve.

However, the conventional on-off drive type control system, which merely opens or closes the solenoid valve, is not adapted to control the flow of the working fluid, so that the cylinder is operated at a constant speed at all times and is not operable at a very low speed. Accordingly, the system has the drawback of necessitating great skill for operating the working implement which requires a delicate movement.

For example, when earth or sand is to be transported by the front loader after scooping with the bucket and if the booms are merely raised, then the booms incline the bucket with its front end raised, permitting the contents of the bucket to spill rearward. To avoid this, the bucket is rotated very slowly with the rise of the booms toward the dumping direction to cause the bucket to assume a corrected posture with its opening positioned horizontally.

Further when earth or sand is to be scooped up again after dumping the contents of the bucket at its raised position by lowering the booms, the bottom of the bucket must be placed on the ground horizontally. Therefore in this case also, the bottom is correctly positioned horizontally by rotating the bucket slowly when the booms are lowered.

Additionally, there arises a need to raise or lower the booms very slowly, for example, to diminish impact upon stopping.

Thus, the operation of the front loader requires low-speed movement of the booms and the bucket, whereas with the conventional control system of the on-off type incorporating switches, the solenoid valve is not adapted for flow control, consequently necessitating great skill for the operation of the loader.

Further, the solenoid valves are conventionally operated merely in an operative relation with the manipulation of the operating lever, so that the control system is not adapted to preset the posture of the bucket and to bring the bucket into the preset posture when the booms are raised or lowered.

On the other hand, control circuits for proportional solenoid valves for use in such control systems include one which has a servo mechanism. The servo mechanism is so operated as to vary the resistance value of a variable resistor in accordance with the amount of manipulation of the operating lever, whereby an energizing current proportional to the movement of the manipulating lever is passed through the valve for controlling the flow of working fluid.

Nevertheless, the control circuit, which necessitates the servo mechanism or the like, has the drawbacks of being very complex in construction, cumbersome to make and liable to malfunctions.

OBJECTS AND SUMMARY OF THE INVENTION

The present invention has been accomplished in order to solve the foregoing problems heretofore encountered.

More specifically, a first object of the present invention is to provide a control apparatus comprising operating means, a control system for a boom and a control system for a working device. Each of the systems has a proportional solenoid valve which is operable in a specified direction in proportion to the amount of manipulation of the operating means when the operating means is manipulated in the specified direction to move the boom or the working device at a speed corresponding to the amount of manipulation.

A second object of the invention is to provide a control apparatus of the type stated wherein the proportional solenoid valve is easily and reliably operable in a proportional relation with the manipulation of the operating means by processing electric signals instead of the servo mechanism or the like conventionally used.

To fulfill these objects, the present invention provides a control apparatus comprising a boom control system and a working device control system each having a proportional solenoid valve. Each of the systems comprises instruction means for producing an instruction signal in accordance with the amount of manipulation of operating means, discriminating means for discriminating the direction of operation of the proportional solenoid valve from the instruction signal, means for generating a specified reference signal, comparison means for comparing the instruction signal with the reference signal to obtain a pulse signal having a pulse width in proportion to the amount of manipulation of the operating means, and drive means for converting the pulse signal from the comparison means into an electric current to drive the proportional solenoid valve in the direction discriminated by the discriminating means.

A third object of the present invention is to provide a control apparatus of the type described wherein the boom control system is proportionally controllable and the posture of the working device is presettable by the working device control system to render the working device automatically controllable to the contemplated posture smoothly when the boom is raised or lowered.

To fulfill this object, the working device control system of the present invention comprises a sensor for detecting the rotated posture of the working device, means for setting the desired posture of the working device, deviation detecting means for determining the difference between a signal from the posture sensor and a signal from the setting means to produce a deviation signal, means for discriminating from the deviation signal from the direction in which the working device is to be rotated, comparator means for comparing the deviation signal with the reference signal from the reference signal generating means to produce a pulse signal of a pulse width in proportion to the deviation signal, and drive means for converting the pulse signal from the comparator means into an electric current to drive the proportional solenoid valve in the direction of rotation of the working device determined by the discriminating means.

A fourth object of the present invention is to provide a control circuit which is most suitable for controlling the proportional solenoid valve included in the type of control apparatus for the working implement described.

For this purpose, the invention provides a control circuit comprising instruction means for producing an instruction signal in accordance with the amount of manipulation of operating means, discriminating means for discriminating the direction of operation of the proportional solenoid valve from the instruction signal, means for generating a specified reference signal, comparison means for comparing the instruction signal with the reference signal to obtain a pulse signal having a pulse width in proportion to the amount of manipulation of the operating means, and drive means for converting the pulse signal from the comparison means into an electric current to drive the proportional solenoid valve in the direction discriminated by the discriminating means.

BRIEF DESCRIPTION OF THE DRAWINGS

FIGS. 1 to 15 show a first embodiment of the present invention;

FIG. 1 is a side elevation showing a tractor and a front loader attached thereto;

FIG. 2 is a sectional view showing a sensor;

FIG. 3 is a rear view showing operating means;

FIG. 4 is a rear view in section showing the operating means;

FIG. 5 is a view in section taken along the line X—X in FIG. 4;

FIG. 6 is a view in section taken along the line Y—Y in FIG. 4;

FIG. 7 is a diagram of a hydraulic circuit;

FIG. 8 is an electric circuit diagram of control systems;

FIG. 9 is a diagram showing the waveforms of signals;

FIG. 10 is a diagram illustrating control positions;

FIG. 11 shows postures of a bucket as related to the sensor;

FIG. 12 is a diagram illustrating voltage setting;

FIGS. 13 and 14 are diagrams for illustrating operation;

FIG. 15 is a diagram showing the relation between the posture of the tractor and sensors;

FIG. 16 is a hydraulic circuit diagram;

FIGS. 17 and 18 are electric circuit diagrams showing control systems;

FIG. 19 is a diagram showing signal waveforms;

FIG. 20 is a side elevation in section showing operating means;

FIG. 21 is a rear view in section showing the operating means;

FIGS. 22 to 24 are electric circuit diagrams showing other embodiments of the invention.

DESCRIPTION OF THE PREFERRED EMBODIMENTS

The present invention will be described below in detail with reference to the illustrated preferred embodiments.

FIGS. 1 to 15 show a front loader embodying the invention and attached to a tractor.

Figures 1, 2, 3:
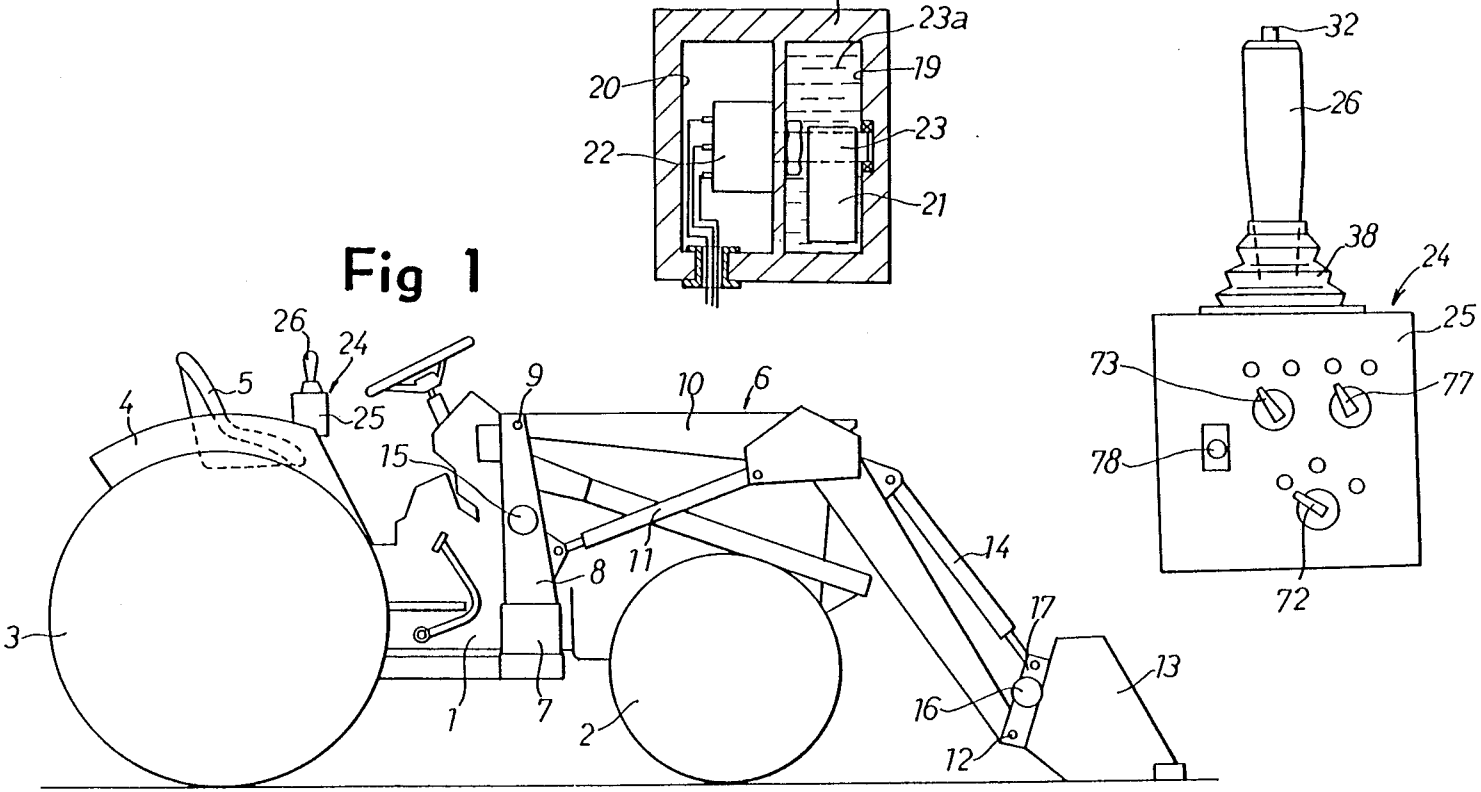

With reference to FIG. 1, indicated at 1 is the tractor body, at 2 front wheels, at 3 rear wheels, at 4 a rear wheel fender, and at 5 a driver's seat. The front loader, which is indicated at 6, comprises a pair of opposite masts 8 removably attached in an upright position to opposite sides of the tractor body 1 by a pair of opposite mount frames 7, a pair of opposite booms 10 liftably mounted by pivots 9 on the upper ends of the masts 8, a pair of opposite boom cylinders 11 for raising or lowering the booms 10, a bucket (working device) 13 rotatably supported by a pivot 12 on the forward end of each boom 10, and a pair of opposite bucket cylinders 14 for pivotally moving (rotating) the bucket 13.

An inclination sensor 15 for detecting the inclination of the tractor body 1 is mounted on the front loader 6, for example, on one of the pair of masts 8. A posture sensor 16 for detecting the posture of the bucket 13 when it is rotated is attached to a bracket 17 on the rear side of the bucket 13. As seen in FIG. 2, these sensors 15, 16 comprise a weight plate 21 and a variable resistor 22 provided respectively in two separated chambers 19 and 20 within a box-shaped case 18. The weight plate 21 is mounted on a rotatable shaft 23 supported by the case 18, while the variable resistor 22 is operatively connected by the shaft 23 to the weight plate 21. Accordingly, a change in the posture of the tractor body 1 or the bucket 13 moves the weight plate 21, causing the resistor 22 to produce a voltage signal in accordance with the posture. A damper oil **23*a* is contained in the chamber 19**.

With reference to FIGS. 3 to 6, operating means 24 comprises a case 25 mounted on the rear-wheel fender 4 at one side of the driver's seat 5, an operating lever 26 movable forward, rearward, leftward, rightward or in any one of different oblique directions and supported by the case 25, first and second variable resistors 27, 28 accommodated in the case 25 and operatively connected to the operating lever 26, etc. More specifically, the operating lever 26 is supported by a transverse rod 30 on a movable frame 29 which is rectangular when seen from above and which is supported by longitudinal rods 31 to the case 25. Accordingly, the operating lever 26 is movable in a desired direction as indicated by arrows in FIG. 6, about the two axes, intersecting each other at right angles, of the transverse rod 30 and the longitudinal rods 31. The lever 26 is resiliently held in a neutral position by unillustrated spring means. The first variable resistor 27 constitutes raising-lowering instruction means for instructing the booms to rise or lower, is operable by the forward or rearward movement of the operating lever 26 through the transverse rod 30 and produces a raising or lowering (up-down) instruction signal of a voltage which varies with the amount of movement or manipulation of the operating lever 26. The second variable resistor 28 constitutes rotation instruction means for instructing the bucket 13 to rotate, and is operable by a left or right movement of the operating lever 26 through the longitudinal rod 31 and the movable frame 29 to produce an instruction signal of a voltage which varies with the amount of manipulation of the lever 26.

The operating lever 26 has a posture holding switch 32 of the push button type at its upper end and a semi-spherical actuating portion 33 at its lower end. Provided within the case 25 at its bottom are a raising switch 34, lowering switch 35, dumping switch 36 and a scooping switch 37 which are arranged around the actuating portion 33 in front and rear thereof and at left and right sides thereof, respectively. These switches are actuated by the portion 33 when the operating lever 26 is manipulated to the greatest extent. A flexible cover is indicated.

Figure 7:
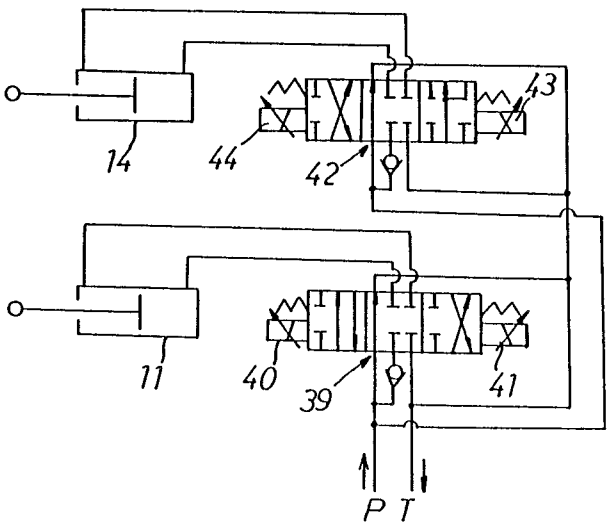
Figure 5:
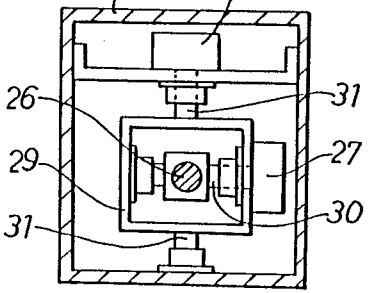
Figure 6:
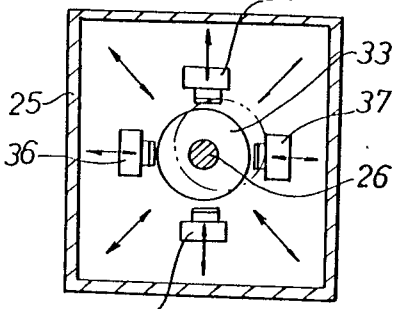
Figure 4:
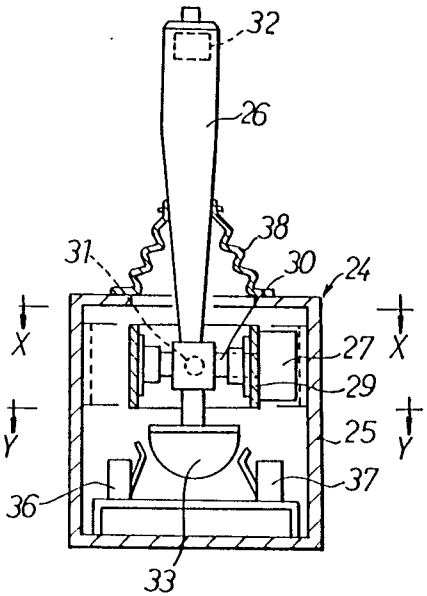

FIG. 7 shows a hydraulic circuit for the lift cylinder 11 and the bucket cylinder 14. A first proportional solenoid valve 39 of the flow proportional type for controlling the lift cylinder 11 has a raising solenoid 40 and a lowering solenoid 41. A second proportional solenoid valve 42 of the flow proportional type for controlling the bucket cylinder 14 has a dumping solenoid 43 and a scooping solenoid 44.

Figure 8:
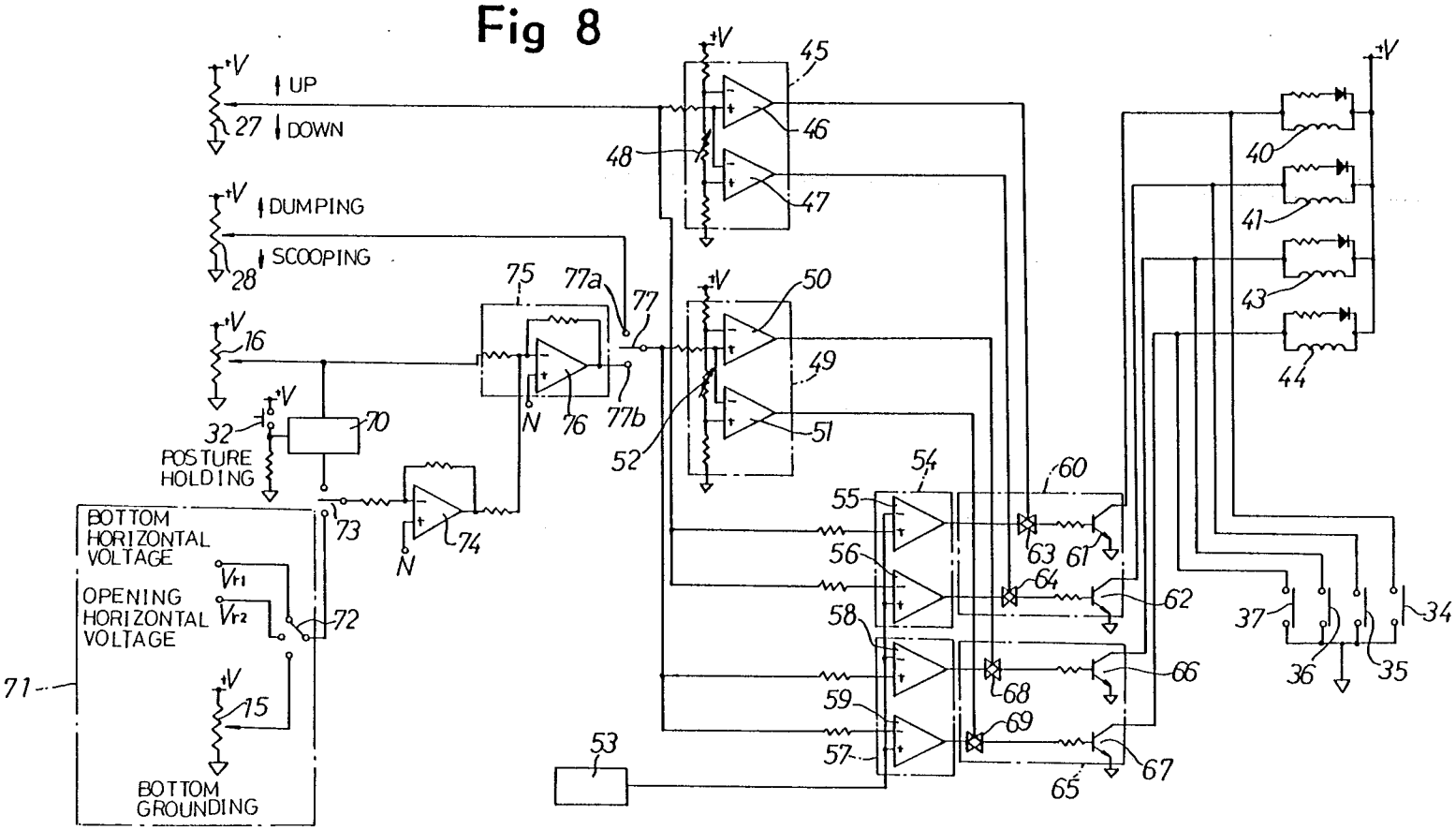

The proportional solenoid valves 39 and 42 are driven under the control of a control circuit shown in FIG. 8. With reference to FIG. 8, first discriminating means 45 for discriminating the direction of upward downward movement comprises two comparators 46, 47, a variable resistor 48 provided therebetween for setting a dead zone ±alpha, etc. When the instruction signal from the first variable resistor 27 is greater than an upper reference value, $\frac{1}{2}V+$alpha, the comparator 46 produces an up signal, while if the signal is smaller than a lower reference value, $\frac{1}{2}V-$alpha, the comparator 47 produces a down signal. Second discriminating means 49 for discriminating the direction of movement for dumping or scooping comprises two comparators 50, 51, a variable resistor 52, etc. like the first means 45. The comparator 50 produces a dumping signal, or the comparator 51 produces a scooping signal 51, in accordance with the instruction signal from the second variable resistor 28.

A triangular wave oscillation circuit 53, serving as a reference signal generating means, generates a reference signal of predetermined frequency, i.e. a triangular wave signal a as seen in FIG. 9. First comparison means 54 comprises two comparators 55, 56 and compares the instruction signal b from the first variable resistor 27 with the triangular wave signal a from the oscillation circuit 53 to produce a pulse signal c of a width in proportion to the variation of the instruction signal b, i.e. to the amount of manipulation of the operating lever 26, as seen in FIG. 9. The comparators 55 and 56 are in opposite relation to each other with respect to the input of the instruction signal b and the triangular wave signal a. The comparator 55 is on when the instruction signal b is greater than the triangular wave signal a and is off when the signal b is smaller than the signal a, producing the pulse signal c of FIG. 9. The comparator 56 is on when the signal b is smaller than the signal a and is off when the signal b is greater, in reverse relation to the case shown in FIG. 9. Second comparison means 57 comprises two comparators 58, 59 and, like the first comparison means 54, produces a pulse signal of a width in proportion to the instruction signal from the second variable resistor 28, based on the instruction signal and the triangular wave signal from the oscillation circuit 53.

First drive means 60 converts the pulse signal from the first comparison means 54 into an electric current to drive the first proportional solenoid valve 39. The drive means comprises switching elements 61, 62 connected to the solenoids 40, 41 and analog switches 63, 64 for applying the pulse signal from the comparators 55, 56 to the elements 61, 62, respectively. When the signal from the comparators 55, 56 of the first discriminating means 54 is fed to the analog switches 63, 64, the switching elements 61, 62 are turned on and off in synchronism with the pulse signal. Like the first drive means 60, the second drive means 65 for converting the pulse signal from the second comparison means 57 into an electric current to drive the second solenoid valve 42 comprises switching elements 66, 67 and analog switches 68, 69.

Sample holding means 70 is adapted to hold an input signal from the posture sensor 16 for a predetermined period of time when the holding switch 32 on the grip of the operating lever 26 is turned on. Means 71 for setting the desired position of the bucket 13 comprises a posture selection switch 72 for selecting and setting one of a bottom horizontal voltage Vr1 required for making the bottom of the bucket 13 horizontal, an opening horizontal voltage Vr2 required for making the bucket opening horizontal and a voltage supplied from the inclination sensor 15 and indicating the inclination of the tractor body 1. The inclination sensor 15 is used for placing the bottom of the bucket 13 on the ground. A change-over switch 73 is provided for selecting the signal from the sample holding means 70 or the signal from the setting means 71. Inversion means 74 is adapted to invert the signal from the change-over switch 73 with reference to a reference voltage $\frac{1}{2}V$ at an N terminal. Deviation detection means 75 adds the signal from the inversion means 74 to the signal from the posture sensor 16 to detect the difference therebetween, which is then amplified by an inverter 76. A manual-automatic change switch 77 is closed at a contact 77*a* for manual control to transmit the instruction signal from the second variable resistor 28, or at a contact 77*b* for automatic control to transmit the signal from the deviation detection means 76. The signal is fed from the switch 77 to the second discrimating means 49 and to the second comparison means 57. As seen in FIG. 3, the switches 72, 73 and 77 are mounted on the rear side of the case 25 along with a power supply switch 78.

The first variable resistor 27, first discriminating means 45, first comparison means 54, first drive means 60 and first proportional solenoid valve 39 constitute a boom control system. The second variable resistor 28, second discriminating means 49, second comparison means 57, second drive means 65 and second proportional solenoid valve 42 constitute a working device control system. The triangular wave oscillation circuit 53 singly is provided for the two, control systems.

When the inclination sensor 15 is mounted on the mast 8 of the front loader 6 as seen in FIG. 1, this means that the front loader 6 is provided with both the posture sensor 16 and the inclination sensor 15, assuring the advantages that the sensors are adjustable at the factory when the front loader is manufactured and that the loader is easy to attach to or remove from the tractor body 1. However, the inclination sensor 15 may be attached to the tractor body 1.

Further, if the signal from the inclination sensor 15 is shown on a display such as an array of diodes, then the display is usable as an inclination indicator for the tractor. Further if the output of the posture sensor 16 is made visible on a display, then the display serves as a posture indicator for the bucket 13.

Although the change-over switch 73 is provided in addition to the selection switch 72 as seen in FIG. 8, the change-over switch 73 can be dispensed with if the sample holding means 70 is incorporated into the setting means 71.

The working device is not limited to the bucket 13 but may be a fork or some other attachement. In this case, the working devices can be made to be interchangeable as desired by pivoting a mount bracket to the forward ends of the booms and removably attaching the device to the bracket by pins. The posture sensor 16 is then attached to the mount bracket. This assures great convenience, since the need to attach the sensor 16 to the device every time it is replaced is eliminated.

The control apparatus operates as follows for the operation of the front loader 6.

For manual control, the manual-automatic change switch 77 is closed at the contact 77*a*. Subsequently, the operating lever 26 is manipulated. The operating lever 26 is movable in the directions of the arrows shown in FIG. 6 for the upward and downward movements of the booms 10, dumping and scooping movements of the bucket 13 and combinations of such movements (see FIG. 10). The lever 26 automatically returns to the neutral position in the center when it is released by hand.

Now, when the lever 26 is turned rearward toward "UP", the first variable resistor 27 is operated through the transverse rod 30, giving an altered resistance value in accordance with the amount of manipulation and producing an instruction signal of increased voltage. It is assumed that when the lever 26 is in its neutral position, the resistance value of the resistor 27 is ½ of its maximum value and that the voltage then available is ½ of the supply voltage V. This will be referred to as a "neutral point." The instruction signal from the first resistor 27 is fed to the comparators 46, 47 of the first discriminating means 45. Since the signal is greater than the neutral point, the comparator 46 interprets this as indicating an upward movement to produce an up signal, which actuates the analog switch 63 of the first drive means 60. The instruction signal from the first resistor 27 is also fed to the comparators 55, 56 of the first comparison means 54. Since the instruction signal is greater than the neutral point, the comparator 55 compares the signal with a triangular wave signal from the oscillation circuit 53, produces a pulse signal which is on when the instruction signal is greater than the triangular wave signal as seen in FIG. 9. As the difference between the two signals becomes greater the pulse width of the pulse signal becomes greater. The switching element 61 is repeatedly turned on and off by the pulse signal through the analog switch 63 of the first drive means 60, and intermittently passes an energizing current of a given value through the up solenoid 40 of the first solenoid valve 39. The valve 39 is opened at the up side to a degree in proportion to the amount of manipulation of the lever 26 by virtue of the dither effect involved, consequently extending the boom cylinder 11 at a predetermined speed and raising the boom 10 about the pivot 9. A variation in the amount of manipulation of the operating lever 26 varies the opening degree of the first solenoid valve 39 to control the flow of pressure oil to be supplied to the boom cylinder 11. As a result, the boom 10 is raised at a speed proportional to the amount of manipulation of the operating lever 26. The speed is controllable from very low to high speeds as desired. The lever 26, when returned to its neutral position, returns the valve 39 to its neutral position to stop the boom 10 at the raised position. When the lever 26 is returned slowly at this time, the boom 10 is brought smoothly and slowly to a stop.

The control apparatus operates similarly when the lever 26 is moved forward to lower the boom 10 or when the lever is moved to the right or left to cause the bucket 13 to perform a scooping or dumping action.

When the lever 26 is moved forward or rearward or sideward through the greatest angle, the actuator 33 closes one of the corresponding switches 34 to 37, operating the valve 39 or 42 by energizing one of the corresponding solenoids 40 to 44. Thus, the valve 39 or 42 is operable without resorting to the operation of the control system. In this case, however, proportional control is not available. This mode of control is therefore effected only in the event of a malfunction.

For automatic control, the manual-automatic change switch 77 is closed at the automatic contact 77*b*. The automatic control is limited only to the postur control of the bucket 13. The boom 10 is controlled in the same manner as above for upward or downward movement by manipulating the lever 26 foward or rearward.

In this case, the posture sensor 16 for detecting the posture of the bucket 13 is used. FIG. 11, (I) to (IV) shows the relation between the posture sensor 16 and the posture of the bucket in scooping, up-down movement with the opening kept horizontal, with the bottom kept horizontal and dumping. FIG. 12 shows the relation between the voltage and the posture sensor 16 for bottom horizontal up-down movement and opening horizontal up-down movement.

Posture control is effected in the following manner for bottom horizontal posture, opening horizontal posture, posture holding and bottom grounding.

Bottom horizontal posture control is resorted to when the boom 10 is lowered to bring the bottom of the bucket 13 horizontally into contact with the ground. In this case, the change-over switch 73 is closed for the setting means 71, and bottom horizontal voltage Vr1 is selected by the selection switch 72. When the bottom of the bucket 13 is in parallel with the horizontal, the voltage (resistance) of the posture sensor 16 is constant at all times irrespective of the posture of the boom 11 or of that of the tractor body 1. Accordingly, the voltage is set equal to the bottom horizontal voltage Vr1 by the potentiometer within the setting means 71 as shown in FIG. 12.

When the selection switch 72 is closed for bottom horizontal, the voltage Vr1 is inverted by the inversion means 74 to a voltage Vr1′ about the ½V voltage at the N terminal. The voltage Vr1′ is added to the voltage detected by the posture sensor 16, the current posture of the bucket 13 by the deviation detection means 75 to determine the difference between the two voltages is indicated, and the resulting output is inverted and amplified by the inverter 76. FIG. 13, (I) to (III) show these characteristics.

If the voltage from the posture sensor 16 is Vr1, then the difference is zero, indicating that there is no need to correct the posture of the bucket 13. The subsequent portion of the system therefore does not function. When the bucket 13 is in a rotated position off a horizontal plane toward the dumping direction, the posture sensor 16 gives an increased voltage, with the result that the deviation detection means 75 produces a deviation voltage (3) as shown in FIG. 13 (III) that is lower than the neutral point voltage. From this deviation voltage, the second discriminating means 49 detects the need for a correction toward the scooping direction. Further the second comparison means 57 compares the deviation voltage with the triangular signal, and a pulse signal of a width in accordance with the deviation voltage is generated. The signal energizes the scooping solenoid 44 of the second solenoid valve 42 via the analog switch 69 and the switching element 67 of the second drive means 65, whereby the bucket cylinder 14 is contracted to correct the posture of the bucket 13 toward the scooping direction. As the posture of the bucket 13 approaches the bottom horizontal posture, the voltage from the sensor 16 diminishes causing the deviation voltage to diminish and the width of the pulse signal to decrease. The bucket cylinder 14 is slowed down and the correcting action at zero deviation is completed. Thus, the bucket 13 is slowed down as it is brought closer to the bottom horizontal posture and eventually comes smoothly to a halt.

Conversely, if the bucket 13 is inclined toward the scooping direction, then the deviation voltage is in the state (2) shown in FIG. 13 (III), and the bucket 13 is moved toward the dumping direction and corrected to the bottom horizontal posture.

The opening horizontal posture control is effected when the boom 10 is raised while holding the opening of the bucket 13 horizontal after scooping up earth or sand with the bucket. For this mode of control, the opening horizontal posture is selected by the selection switch 72. In this case, the opening horizontal voltage Vr2 is set on the potentiometer of the setting means 71 so that it becomes equal to the voltage from the posture sensor 16 becomes equal to when the opening is brought to the horizontal position as seen in FIG. 12.

Figure 14I:
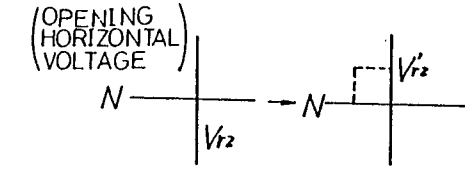
Figure 14:
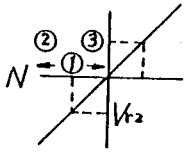

The control system operates in the same manner as the bottom horizontal posture control, and the operation characteristics are shown in FIG. 14, (I) to (III).

For posture holding control, the change-over switch 73 is closed for posture holding, and the holding switch 32 is turned on.

When the boom 10 is raised after a compost heap of the like is scooped up with the bucket 13, the bucket 13 must be maintained in the scooping state. Otherwise, the upward movement would cause the heap to spill from the bucket 13 toward the operator. Therefore, in such a case, a need to raise the bucket 13 held in the scooping posture arises.

Thus, the holding switch 32 is turned on, with the change-over switch 73 set to posture holding, whereupon a voltage indicating the current posture of the bucket 13 is fed to the sample holding means 70 and is held for a predetermined period of time. The held voltage is inverted by the inversion means 74, whereupon the difference between the held voltage and the voltage from the posture sensor 16 is determined by the deviation detection means 75, which produces an inverted voltage. The posture of the bucket 13 is controlled by this deviation voltage in the same manner as in the foregoing bottom or opening horizontal posture control. Consequently, the boom 10 is raised while the bucket 13 retained in the original posture.

Figure 15I:
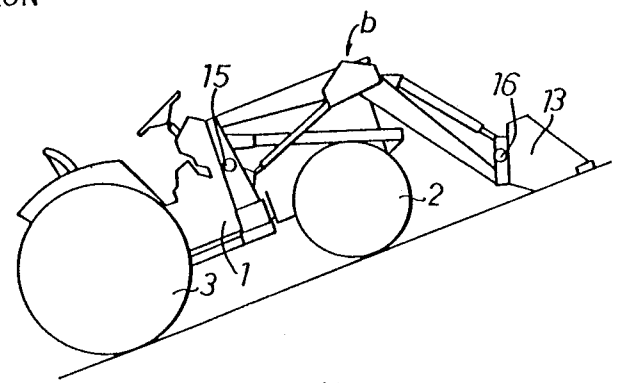
Figure 15:
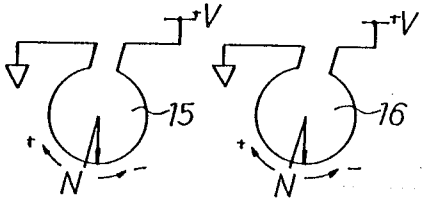

"Bottom grounding posture" refers to the state in which the bottom of the bucket 13 is on the ground in the same plane as the ground on which the front and rear wheels 2, 3 of the tractor body 1 are placed or on which the bottom is on a plane in parallel with the plane as seen in FIG. 15, (I). Bottom grounding control is resorted to when the bucket 13 is lowered onto the ground or used for scooping along the ground surface. This mode of control is very convenient when the bucket 13 is to be placed on the ground since the bonnet then blocks the sight of the operator in the seat 5.

The bottom grounding control differs greatly from the bottom horizontal control. In that in the latter case, control is effected with reference to the angular deviation of the bucket 13 from the direction of gravity. Whereas, the bottom grounding control involves another factor, i.e. the inclination of the tractor body 1, besides the posture of the bucket 13.

Accordingly, the inclination sensor 15 is used for control. As seen in FIG. 15, (II), the setting is so made that the inclination sensor 15 and the posture sensor 16 deliver the same signal voltage (resistance) when the bottom of the bucket 13 is grounded.

The selection switch 72 and the change-over switch 73 are set to the inclination sensor side for bottom grounding. When the tractor body 1 is inclined, the inclination sensor 15 produces an altered voltage that detects the inclination. If the bucket 13 is on the same ground surface as the tractor body at this time, then the posture sensor 16 delivers the same signal voltage as the inclination sensor 15. However, when the voltage from the posture sensor 16 is different, the bucket cylinder 14 functions through the same operation as in the foregoing bottom horizontal posture control where the bucket is brought to a corrected posture in which the bottom is on the ground.

Figure 16:
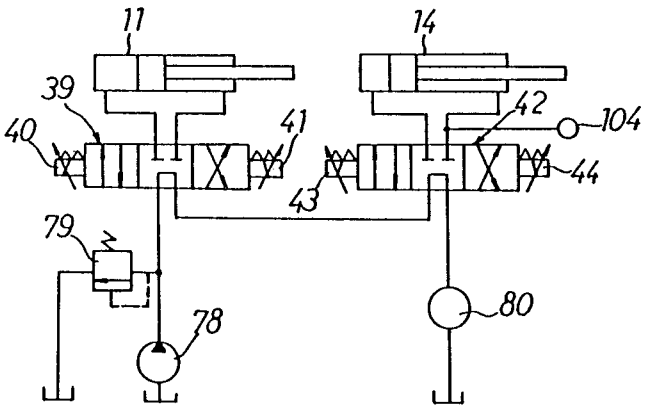

FIGS. 16 to 22 show a second embodiment of the present invention. A first proportional solenoid valve 39 for the boom control system and a second proportional solenoid valve 42 for the working device control system are connected in series with each other as seen in FIG. 16. When these valves 39, 42 are operated at the same time, a hydraulic pump 78 feeds pressure oil to a boom cylinder 11, and the return oil from the cylinder 11 is fed to a bucket cylinder 14. Incidentally in this case, the boom cylinder 11 and the bucket cylinder 14 are mounted in a reverse direction to the case shown in FIG. 1. While the cylinders 11, 14 are approximately identical in capacity and stroke, they may be different from each other in accordance with the length of the boom 10 or the size of the bucket 13. Further although the proportional solenoid valves 39, 42 are approximately identical in size and configuration, they may also be different from each other depending on the size of the cylinders 11, 14, the boom 10 and the bucket 13. Indicated at 79 is a relief valve, and at 80 a hydraulic unit on the tractor body for lifting a working implement. The proportional solenoid valves 39, 42 are controlled approximately in the same manner, and the boom control system and the working device control system are predominantly in a corresponding relation to each other with respect to the constituent circuits and other components, so that like corresponding parts are designated by like reference numerals, with an adscript "a" attached to the numeral for the boom control system or with an adscript "b" attached for the working device control system.

Figure 19:
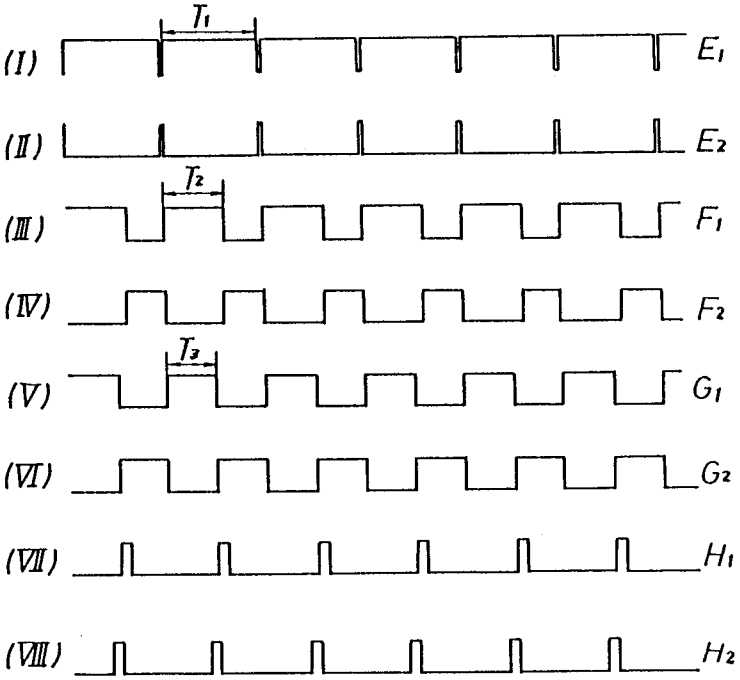
FIGS. 16 to 22 show a second embodiment of the invention.
Figure 17:
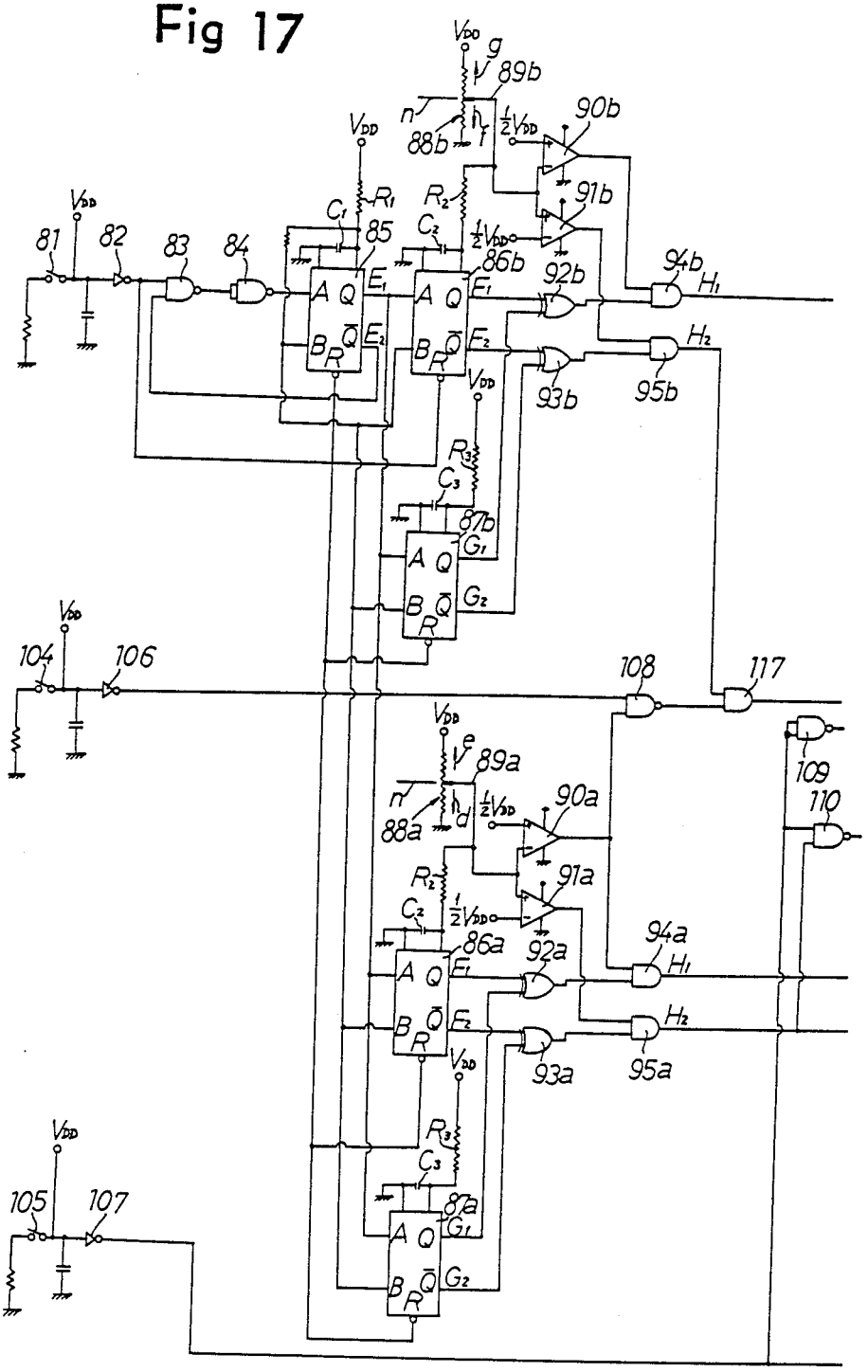
Figure 18:
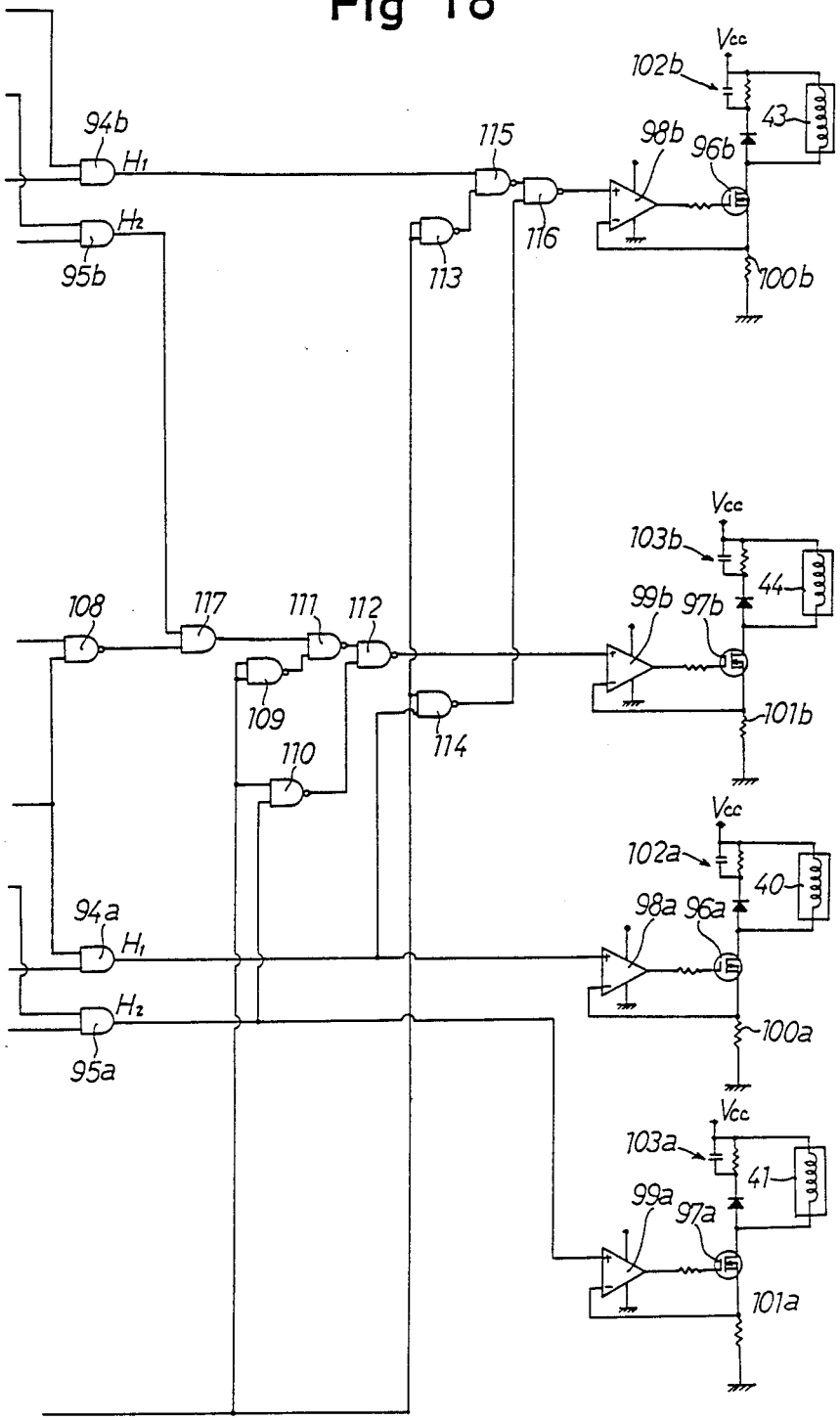

FIGS. 17 and 18 show a main switch 81, a NOT circuit 82, NAND circuits 83, 84, a prepositioned pulse generating circuit 85, instruction pulse generating circuits 86*a*, 86*b* and reference pulse generating circuits 87*a*, 87*b*. By the action of a monostable multivibrator, each of these pulse generating circuits 85, 86*a*, 86*b*, 87*a*, 87*b* deliver a pulse signal from an output terminal Q which rises with the input signal to terminal A and falls with a time constant dependent on a capacitor and resistor of a time-constant circuit. While the NOT circuit 82 is producing a high-voltage output, the prepositioned pulse generating circuit 85 produces a pulse signal E1 of a given frequency from an output terminal Q and a pulse signal E2 from an output terminal $\overline{Q}$. As seen in FIG. 19, (I), the pulse signal E1 has a pulse width T1 which is determined by the time constant of capacitor C1 and resistor R2 of the circuit. The signal E2 is the inverse of signal E1 as shown in FIG. 19, (II). The instruction pulse generating circuit 86*a* (86*b*), which constitutes instruction means along with a variable resistor 88*a* (88*b*), receives at input terminal A the pulse signal E1 from the circuit 85 and delivers a pulse signal F1 from output terminal Q which, as seen in FIG. 19, (III), rises with signal E1 and has a pulse width T2 dependent on the time constant circuit of capacitor C2 and resistor R2 and the variable resistor 88*a* (88*b*). The circuit 86*a* (86*b*) further delivers from output terminal $\overline{Q}$ a pulse signal F2, which is the inverse of pulse signal F1, as shown in FIG. 19, (IV). The resistance of the variable resistor 88*a* (88*b*) is varied by a slider 89*a* (89*b*). The reference pulse generating circuit 87*a* (87*b*), which serves as a reference signal generating means, receives the pulse signal E1 from the prepositioned pulse generating circuit 85 at input terminal A from output terminal Q and, delivers from a pulse signal G1 which, as shown in FIG. 11, (V), rises with the pulse signal E1 and has a pluse width T3 determined by the time constant circuit of capacitor C3 and resistor R3. Further, a pulse signal G2 is delivered from an output terminal $\overline{Q}$ which is obtained by inverting the pulse signal G1 as seen in FIG. 19, (VI).

Comparators 90*a*, 91*a* (90*b*, 91*b*) constitute discriminating means and compare an instruction signal from the slider 89*a* (89*b*) on the variable resistor 88*a* (88*b*) with a voltage $\frac{1}{2}$VDD. When the slider 88*a* (88*b*) is moved toward the direction of arrow d (f) beyond a neutral position n which is the midpoint of the resistor 89*a* (89*b*), the comparator 90*a* (90*b*) produces a high-voltage output. When the slider is moved toward the direction of arrow e (g) beyond the neutral position, the comparator 91*a* (91*b*) produces a high-voltage output.

An exclusive OR circuit 92*a* (92*b*, 93*a*, 93*b*) serving as comparison means compares the pulse signal from the instruction pulse generating cicuit 86*a* (86*b*) with the reference pulse signal from the reference pulse generating circuit 87*a* (87*b*).

Indicated at 94*a* (94*b*, 95*a*, 95*b*) is an AND circuit, and at 96*a* (96*b*, 97*a*, 97*b*) a field-effect transistor, which is connected in series with the solenoid 40 (43, 41, 44). A comparator 98*a* (98*b*, 99*a*, 99*b*) is connected between the AND circuit 94*a* (94*b*, 95*a*, 95*b*) and the gate of the field-effect transistor 96*a* (96*b*, 97*a*, 97*b*) for intermittently driving the transistor with the pulse signal from the AND circuit. One terminal of the comparator 98*a* (98*b*, 99*a*, 99*b*) is connected between the field-effect transistor 96*a* (96*b*, 97*a*, 97*b*) and a resistor 100*a* (100*b*, 101*a*, 101*b*) that is connected in series with the transistor to receive a voltage signal from this resistor. The comparator detects the variation in the energizing current through the solenoid 40 (43, 41, 44) and controls the current amplification by the field-effect transistor 96*a*, (96*b*, 97*a*, 97*b*) so as to render the current constant. A circuit 102*a* (102*b*, 103*a*, 103*b*) for protecting the solenoid 40 (43, 41, 44) comprises a diode, capacitor and resistor.

A pressure siwtch 104 is included in the hydraulic circuit of FIG. 16 at the scooping side of the bucket cylinder 14 and is turned on when the internal pressure of the bucket cylinder 14 exceeds a predetermined level (overload). FIGS. 17 and 18 further show a mode change switch 105, NOT circuits 106, 107, NAND circuits 108 to 116 and an AND circuit 117.

Figure 21:
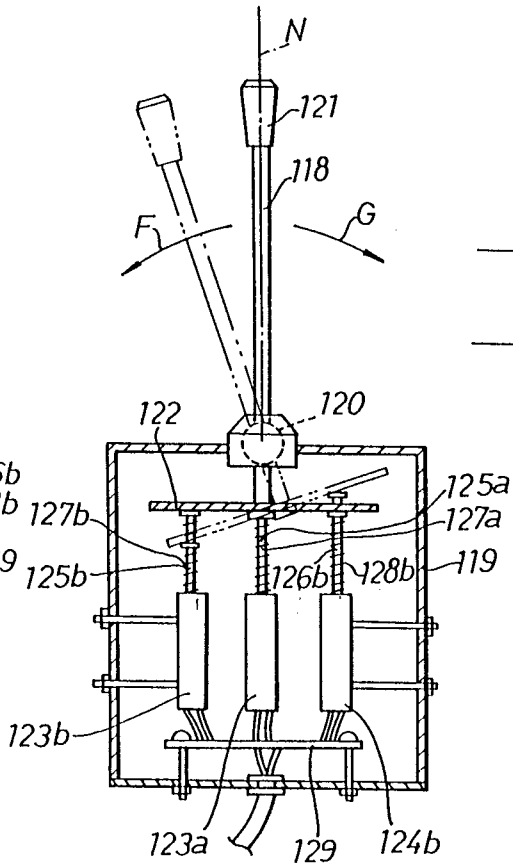
Figure 20:
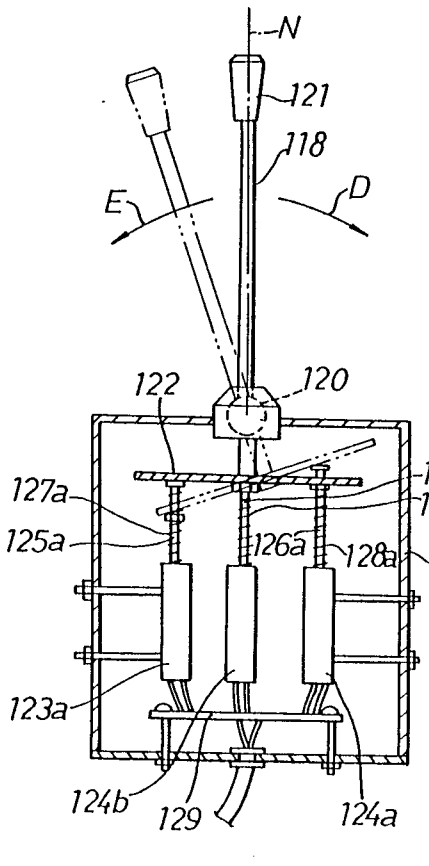

FIGS. 20 and 21 show operating means for the variable resistors 88*a* and 88*b*. An operting lever 118 is supported by a spherical bearing member 120 on the top plate of a control box 119. The lever 118 has a grip 121 at its upper end and an actuating plate 122 at its lower end. Variable resistors 123*a*, 124*a* of the slider type are provided upright within the control box 119 as opposed to longitudinally. Variable resistors 123*b*, 124*b* of the slider type are provided upright within the box 119 as opposed to transversely. The resistors of each pair are arranged symmetrically to the operating lever 118. The resistor 123*a* (123*b*, 124*a*, 124*b*) has a vertically movable slider 125*a* (125*b*, 126*a*, 126*b*), which is vertically biased by a coiled spring 127*a* (127*b*, 128*a*, 128*b*) in pressing contact with the lower side of the actuating plate 122. The resistor 123*a* (123*b*, 124*a*, 124*b*) has its resistance value varied by the movement of the slider 125*a* (125*b*, 126*a*, 126*b*) and is connected to lead wires on a circuit base plate 129. The resistors 123*a*, 124*a* constitute the variable resistor 88*a*, and the resistors 123*b*, 124*b* constitute the variable resistor 88*b*.

When the operating lever 118 is in a vertical neutral position N, the sliders 89*a*, 89*b* in FIG. 17 are in a neutral position n. When the operating lever 118 is moved in the rear as indicated by an arrow D from this position, the slider 89*a* moves in the direction of arrow d. The lever, when moved in the direction of arrow E, moves the slider 89*a* in the direction of arrow e. When the lever 118 is moved to the left as indicated by arrow F, the slider 89*b* moves in the direction of arrow f. When the lever is moved to the right as indicated by an arrow G, the slider 89*b* moves in the direction of arrow g. Further if the lever 118 is moved to the left and leftwardly rearward, the sliders 89*a*, 89*b* are moved in the directions of arrows d, f, respectively. When the lever 118 is moved to the right and rearward, the sliders are moved in the direction of arrows d, g, respectively. When moved to the left and forward, the lever 118 moves the sliders 89*a*, 89*b* in the directions of arrow e, f, while when moved to the right and forward, the lever moves these sliders in the directions of arrows e, g. The mode change switch 105 is provided at the top end of the grip 126 of the operating lever 118. The switch is turned on when it is depressed.

With the present embodiment, the capacitors C1, C2, C3 connected to the pulse generating circuits 85, 86*a*, 86*b*, 87*a*, 87*b* have identical capacitance, while the resistor R3 is one-half of the resistor R1 in resistance value. The resistance of the resistor R2 and the maximum resistance of the variable resistors 88*a*, 88*b* are one-third the resistance of the resistor R1. Accordingly, the pulse width T3 of the pulse signal G1 from the reference pulse generating circuits 87*a*, 87*b* is $\frac{1}{2}$ of the pulse width T1 of the pulse signal E1 from the prepositioned pulse generating circuit 85. When the sliders 89*a*, 89*b* are in the neutral position n, the pulse width T2 of the pulse signal F1 from the instruction pulse generating circuits 86a, 86b is ½ of the pulse width T1 of the pulse signal E1. As the sliders 89a, 89b move from the neutral position toward the direction of arrow d or f, the fall of the pulse signal F1 is delayed, and the pulse width T2 is gradually increased. When the sliders 89a, 89b are moved in the direction of arrow e or g, the pulse signal F1 falls earlier, and the pulse width T2 is progressively decreasing.

The operation of the present embodiment will be described with reference to the voltage waveform diagram of FIG. 19. When the main switch 81 is turned on, the NAND circuit 84 applies a high voltage to the prepositioned pulse generating circuit 85, which in turn delivers a pulse signal E1 from the output terminal Q and a pulse signal E2 from the output terminal $\overline{Q}$ The instruction pulse generating circuits 86a, 86b and the reference pulse generating cicuits 83a, 83b receive the pulse signal E1 from the circuit 85. The instruction pulse generating circuits 86a, 86b deliver a pulse signal F1 from the output terminal Q and a pulse signal F2 from the output terminal $\overline{Q}$ The reference pulse generating circuits 87a, 87b produce a pulse signal G1 from the output terminal Q and a pulse signal G2 from the output terminal $\overline{Q}$.

When the operating lever 118 is in the neutral position N at this time, the sliders 89a, 89b are in the neutral position n. The pulses F1, F2 of the instruction pulse generating circuits 86a, 86b then have the same pulse width as the pulse signals G1, G2 of the reference pulse generating circuits 87a, 87b, with the result that the exclusive OR circuits 92a, 92b, 93a, 93b produce no pulse signal. Further since the sliders 89a, 89b are in the neutral position n, no signal is delivered from the comparators 90a, 90b, 91a, 91b. Consequently, no signal is produced from the AND circuits 94a, 94b, 95a, 95b or from the comparators 96a, 96b, 97a, 97b, and the solenoids 40, 41, 43, 44 remain unenergized.

When the boom 10 is to be lowered by operating the first proportional solenoid valve 39 of the boom control system, the operating lever 118 is moved rearward from the neutral position N. The rearward movement (in the direction of arrow D) of the lever 118 from the neutral position N moves the slider 89a in the direction of arrow d, consequently increasing the pulse width T2 of the pulse signal F1 of the instruction pulse generating circuit 86a in proportion to the amount of movement or manipulation of the operating lever 118. Therefore, the width T2 of the pulse signal F1 becomes larger than the width T3 of the pulse signal G1 of the reference pulse generating circuit 87a, causing the exclusive OR circuit 92a to produce a pulse signal H1 as seen in FIG. 19, (VII). On the other hand, the voltage signal of the slider 89a is lowered when moved in the direction of arrow d, and the comparator 90a produces an up signal of high voltage, which opens the gate of the AND circuit 94a. As a result, the circuit 94a transmits the pulse signal H1, which is delivered to the field-effect transistor 96a via the comparator 98a. The transistor 96a repeats an on-off action in timed relation with the pulse signal H1. Therefore, an energizing current of a given value intermittently flows through the up solenoid 40. By virtue of the dither effect involved, the first proportion solenoid valve 39 operates with a degree of opening in accordance with the amount of manipulation of the lever 118 to control the flow of oil through the boom cylinder, consequently raising the boom 10 at a speed in proportion to the amount of forward manipulation of the operating lever 118.

When the operating lever 118 is moved forward (toward the direction of arrow E) from the neutral position N, the slider 89a moves in the direction of arrow e. Consequently, the pulse width of the pulse signal F2 of the instruction pulse generating circuit 86a and is increased the exclusive OR circuit 93a produces a pulse signal H2 as seen in FIG. 19, (VIII). Further, the movement of the slider 89a toward the direction of arrow e causes the comparator 91a to produce a signal, which opens the gate of the AND circuit 95a. Consequently, the transistor 97a repeats an on-off action as in the foregoing case, and an energizing current of a given value to flow through the down solenoid 41. By virtue of the dither effect involved, the first proportional solenoid valve 39 effects the flow control in accordance with the amount of rearward movement of the lever 118 to lower the boom 10 at a speed in proportion to the amount of rearward movement of the lever 118.

Next, when the bucket 13 is to be used for scooping by operating the second proportional solenoid valve 42 of the working device control system, the operating lever 118 is moved to the left (in the direction of arrow F) from the neutral position N, whereby the slider 89b is moved in the direction of arrow f. Consequently, in the same manner as already described, the exclusive OR circuit 92b produces a pulse signal H1 as shown in FIG. 19, (VII), and the gate of the AND circuit 94b is opened to pass the pulse signal H1 therethrough. Further if the operating lever 118 is moved to the right (in the direction of arrow G) from the neutral position N, then the slider 89b moves in the direction of arrow g. Consequently the exclusive OR circuit 93b produce a pulse signal H2 as seen in FIG. 19, (VIII) and the gate of the AND circuit 95b, is opened which in turn passes the pulse signal H2 therethrough.

When the mode change switch 105 is off, the NOT circuit 107 applies a low voltage to the NAND circuits 109, 110 and to the NAND circuits 113 and 114 NAND circuit 111 invests the output signal of the AND circuit 94a. The pulse signal H2 of the AND circuit 95a is delivered as inverted by the NAND circuit 110. Further via the NAND circuit 115, the pulse signal H1 from the AND circuit 94b is delivered as it is from the NAND circuit 116.

When the mode change switch 105 is on, the NOT circuit 107 applies a high voltage to the NAND circuits 109, 110, 113 and 114. The NAND circuit 109 delivers an output of low voltage, and the NAND circuit 111 delivers an output of high voltage. Via the NAND circuit 110, the pulse signal H2 from the AND circuit 95a is delivered as it is from the NAND circuit 112. Similarly, via the NAND circuit 114, the pulse signal H1 from the AND circuit 94a is delivered as it is from the NAND circuit 116.

When the pressure switch 104 is off, the NOT circuit delivers an output of low voltage, and the NAND circuit 108 produces an output of high voltage which opens the gate of the AND circuit 117. The pulse signal H2 from the AND circuit 95b is fed out as it is from the AND circuit 117.

When the pressure switch 104 is on, the output of the NOT circuit 106 is of high voltage, so that if the output of the comparator 90a is a high voltage, that is, if the operating lever 118 is turned to a rearward position, then the NAND circuit 108 produces a low voltage and the NAND circuit 111 produces a high voltage. In this case, the output of the comparator 31*a* is a low voltage, so that the output of the NAND circuit 110 is a high voltage, and the NAND circuit 112 produces a low voltage. On the other hand, if the output of the comparator 90*a* is low, that is, the lever 118 is in a rearward position, then the pulse signal H2 of the AND circuit 95*b* is delivered as it is from the AND circuit 117.

Accordingly, when the mode change switch 105 is off, the pulse signal H2 from the AND circuit 94*b* is produced from the NAND circuit 116, and the pulse signal H2 from the AND circuit 95*b* is delivered from the NAND circuit 112. Alternatively, if the mode change switch 105 is on, then the pulse signal H1 of the AND circuit 94*a* is produced from the NAND circuit 116, and the pulse signal H2 of the AND circuit 95*a* is fed out from the NAND circuit 112. However, when the pressure switch 104 is on by turning the operating lever 118 in a rearward position, the NAND circuit 112 delivers a low voltage irrespective of whether the mode change switch 105 is on or off.

When the operating lever 118 is moved left with the mode change switch 105 in its off state, the pulse signal H1 from the AND circuit 94*b* is fed to the field-effect transistor 96*b* via the NAND circuits 115, 116 and the comparator 98*b*, and the transistor 96*b* repeats an on-off action in synchronism with the pulse signal H1. Consequently, an energizing current of a given value intermittently flows through the dumping solenoid 43 and, owing to the dither effect involved, the second proportional solenoid valve 42 effects the flow control in accordance with the movement to the left of the operating lever 118. Thereby, the bucket 13 performs a dumping motion at a speed in proportion to the manipulation to the left of the lever 118. Further when the operating lever 118 is moved right, the pulse signal H2 from the AND circuit 95*b* is fed to the field-effect transistor 97*b* via the AND circuit 117, NAND circuits 111, 112 and comparator 99*b*, and the transistor 97*b* repeat an on-off action which allows an energizing current of a given value to intermittently flow through the scooping solenoid 44. By virtue of the dither effect involved, the second proportional solenoid valve 42 operates for flow control in accordance with the manipulation to the right of the lever 118, and the bucket 13 performs a scooping motion at a speed in proportion to the manipulation to the right of the lever 118. When the operating lever 118 is moved to the right and rear to raise the boom 10 for the scooping motion of the bucket 13, the forward end of the bucket 13 is likely to bite into hard earth or to become engaged by a rock or the like. If the internal pressure of the bucket cylinder 14 exceeds a specified level in such an event, then the pressure switch 104 is turned on, whereupon the NAND circuit 112 produces a low voltage which discontinues the scooping action of the bucket 13, thereafter the rise of the boom 10 is only allowed when the bucket 14 is held at rest. This obviates the damage due to overloading and eliminates the need to discontinue the operation.

On the other hand, when the operating lever 118 is moved to the rear with the mode change switch 105 depressed and held in an on state, the pulse signal H1 from the AND circuit 94*a* is fed to the field-effect transistor 96*b* via the NAND circuits 114, 116 and the comparator 98*b*, and the transistor 96*b* repeats an on-off action in synchronism with the pulse signal H1. Consequently, the boom 10 rises at a speed in proportion to the amount of manipulation to the rear of the operating lever 118, and at the same time, the bucket 13 performs a dumping motion at a corresponding speed. Thus, the boom 10 rises with the bucket 13 held substantially at a definite angle of inclination with respect to a horizontal plane. Further, if the lever 118 is similarly moved forward, then the pulse signal H2 from the AND circuit 95*a* is fed to the field-effect transistor 97*b* by way of the NAND circuits 110, 112 and the comparator 99*b*, and the transistor 97*b* repeats an on-off action. As a result, the boom 10 lowers at a speed in proportion to the amount of forward movement of the operating lever 118 and, at the same time, the bucket 13 performs a scooping motion at a corresponding speed. Thus, the boom 10 lowered while the bucket 13 is held at a given angle of inclination with respect to a horizontal plane.

The mode change means comprises the mode change switch 105, and 109 to 112, NAND circuits 113 to 116, etc. The means for discontinuing the scooping motion of the bucket 13 comprises the NOT circuit 106, NAND circuit 108, AND circuit 117, etc.

Figure 23:
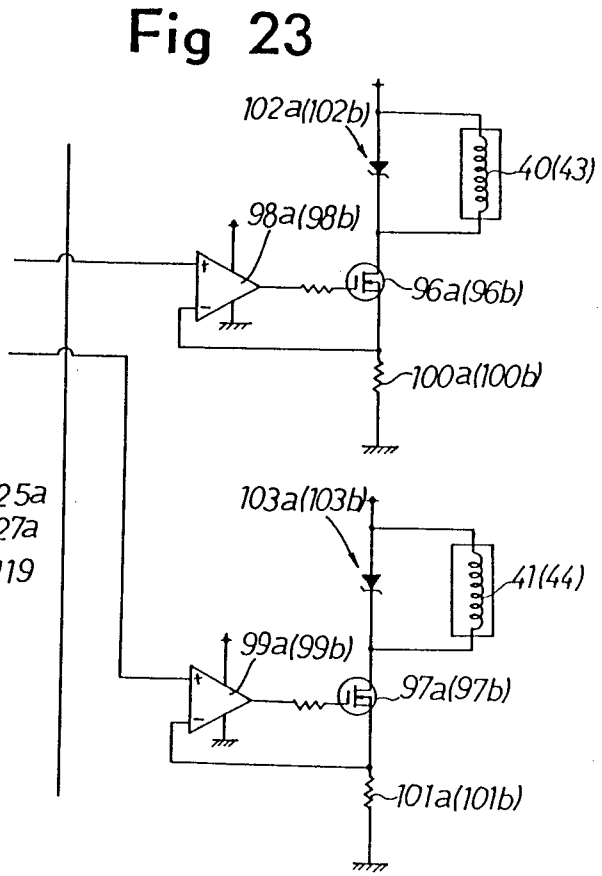
Figure 22:
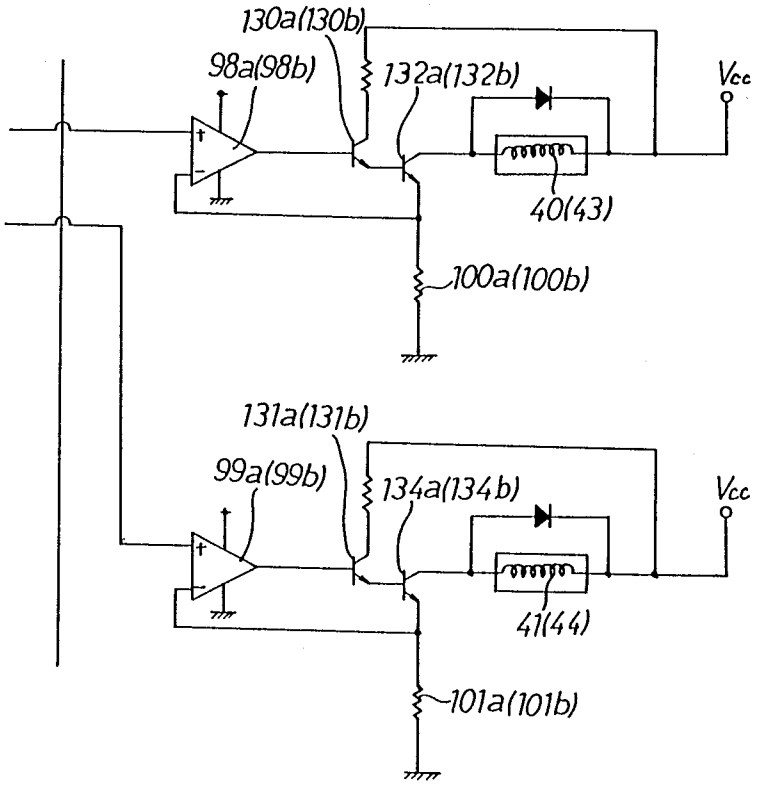

FIGS. 22 and 23 show other embodiments. FIG. 22 shows Darlington pairs of transistors 130*a*, 130*t*, 131*a*, 131*b*, 132*a*, 132*b*, 133*a*, 133*b* which substitute the foregoing switching circuits of field-effect transistors 96*a*, 96*b*, 97*a*, 97*b*. FIG. 23 shows solenoid protecting circuits 102*a*, 102*b*, 103*a*, 103*b* where each comprises a Zener diode.

Figure 24:
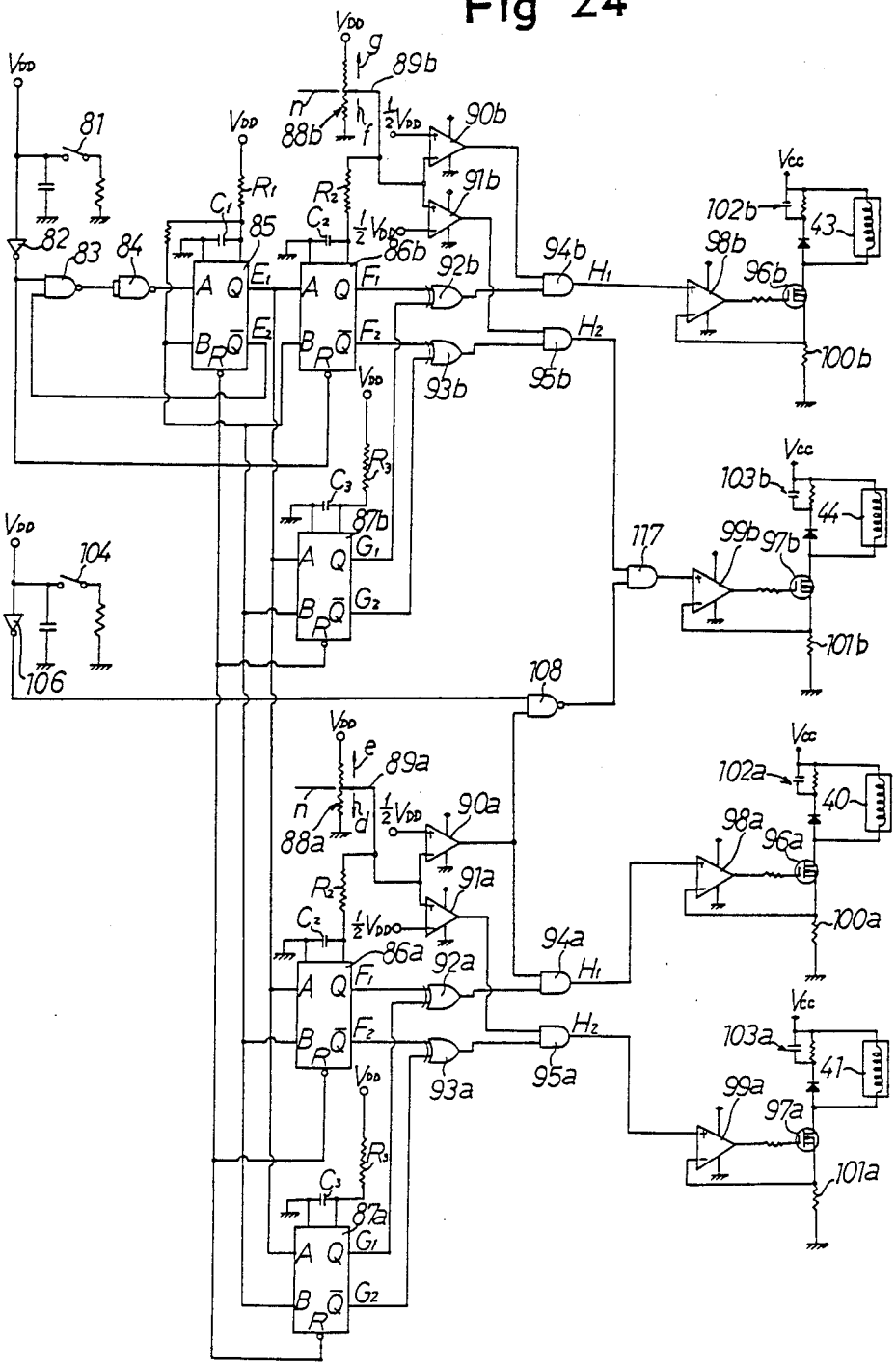

FIG. 24 shows another embodiment which is obtained by omitting the mode change switch 105, NOT circuit 107, NAND circuits 109 to 112 and NAND circuits 113 to 116 from the foregoing embodiment.

The pulse width and the frequency of the pulse signals to be generated by the circuits 85, 86*a*, 86*b*, 87*a*, 87*b* are adjustable by variably setting the values of the resistors R1, R2,R3, 35*a*, 35*b* so as to be most suited to the performance or characteristics of the proportional solenoid valves 39, 42.

Although the operating lever 118 is used as operating means for raising or lowering the boom 1 and for moving the bucket 13 for scooping or dumping, the operating means is not limited to the lever 118 but can be of the dial type. Further separate operating means are usable; one for moving the boom 10 and the other for moving the bucket 13.

Figure 25:
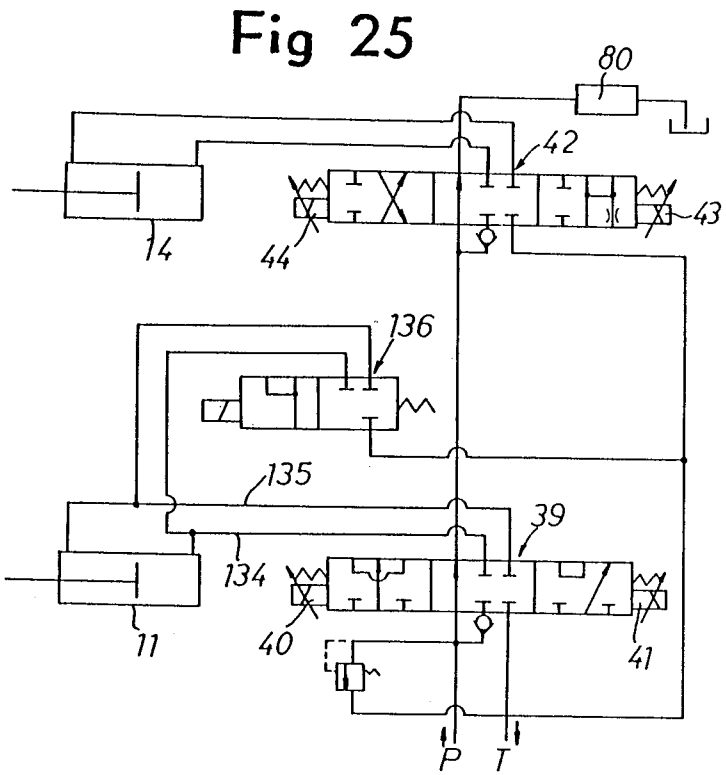
FIG. 25 is a hydraulic circuit diagram showing another embodiment of the invention.

FIG. 25 shows another embodiment of hydraulic circuit. Channels 134, 135 for connecting the boom cylinder 11 to the proportional solenoid valve 39 are provided with a floating solenoid valve 136 for bringing the channels 134, 135 into or out of communication with each other. When the valve 136 is energized, the two cylinder chambers of the boom cylinder 11 communciate with each other via the channels 134, 135 to render the boom 10 movable upward or downward in a floating state.

What is claimed is:

1. A control apparatus for a boom-equipped working implement having a boom control system for controlling an upward-downward movement of a boom liftably supported by a vehicle body and a working device control system for pivotally controlling a working device movably mounted on the boom, each of said control systems comprising a proportional solenoid valve;

instruction means for producing an instruction signal in response to an amount of manipulation of an operating means;

discriminating means for determining a desired operating direction of the proportional solenoid valve from the instruction signal;

reference signal generating means for generating a predetermined reference signal;

comparison means for comparing the instruction signal with the predetermined reference signal to develop a pulse signal having a pulse width in proportion to the amount of manipulation of the operating means; and drive means for converting the pulse signal from the comparison means into an electric current to drive the proportional solenoid valve in a direction determined by the discriminating means.

2. A control apparatus as defined in claim 1 wherein the instruction means comprises a variable resistor for producing an instruction voltage signal, and the predetermined reference signal generating means comprises a triangular wave oscillation circuit for developing a triangular wave signal for comparing with the instruction voltage signal by the comparison means.

3. A control apparatus as defined in claim 1 wherein the instruction signal results from a variable resistor operatively connected to the operating means and a pulse generating circuit for producing pulse signals of opposite phases, and the variable resistor is connected to a time-constant circuit for adjusting the pulse width of the pulse generating circuit.

4. A control apparatus as defined in claim 1 wherein each of the instruction means and the reference signal generating means has a pulse generating circuit for producing pulse signals of opposite phases, and the comparison means compares pulse signals from the two pulse generating circuits of the instruction means and the reference signal generating means.

5. A control apparatus as defined in claim 1 wherein the boom control system and the working device control system have the operating means in common with each other, and the instruction means of the boom control system operatively controls a forward-rearward manipulation of the operating means and the instruction means of the working device control system operatively controls a rightward-leftward manipulation of the operating means.

6. A control apparatus as defined in claim 1 wherein the boom control system and the working device control system have the reference signal generating means in common with each other.

7. A control apparatus as defined in claim 1 which further comprises a sensor for detecting an excessive load acting on the working device so that when the boom and the working device are in movement at the same time, the working device is stopped from pivotal movement upon the sensor detecting the excessive load.

8. A control apparatus as defined in claim 1 wherein the proportional solenoid valve of the working device control system is operable by the pulse signal from the boom control system so that when the boom is in the upward-downward movement, the working device is moved in a direction opposite to the direction of the movement of the boom.

9. A control apparatus for a boom-equipped working implement having a boom control system for controlling an upward-downward movement of a boom liftably supported by a vehicle body and a working device control system for pivotally controlling a working device movably mounted on the boom, said boom control system comprising:

a proportional solenoid valve;

instruction means for producing an instruction signal in response to an amount of manipulation of an operating means;

discriminating means for determining a desired operating direction of the upward-downward movement of the boom from the instruction signals;

reference signal generating means for generating a predetermined reference signal;

comparison means for comparing the instruction signal with the predetermined reference signal to develop a pulse signal having a pulse width in proportion to the amount of manipulation of the operating means; and drive means for converting the pulse signal from the comparision means into an electric current to drive the solenoid valve of the boom control system in the operation direction of the upward-downward movement of the boom determined by the discriminating means, said working device control system comprising: comprises;

posture sensor means for detecting a pivotally moved posture of the working device;

setting means for setting the desired pivotally moved posture of the working device;

deviation detecting means for determining the difference between a signal from the posture sensor means and a signal from the setting means to produce a deviation signal;

discrimination means for determining a direction of movement of the working device to be pivotally moved as determined by the deviation signal;

comparator means for comparing the deviation signal with the predetermined reference signal from the reference signal generating means to produce a pulse signal of a pulse width in proportion to the deviation signal; and drive means for converting the pulse signal from the comparator means into an electric current to drive the solenoid valve of the working device control system in the direction of movement of the working device determined by the discrimination means.

10. A control apparatus as defined in claim 9 wherein the reference signal generating means comprises a triangular wave oscillation circuit.

11. A control apparatus as defined in claim 9 wherein the working device is a bucket, and the bottom horizontal, opening horizontal or bottom grounding posture of the bucket is selectively settable by the setting means.

12. A control apparatus as defined in claim 9 which further comprises sample holding means for storing a signal from the posture sensor means upon actuation of a posture holding switch on the operating means and the deviation detecting means determines the difference between a signal from the posture sensor means and a signal from the sample holding means.

13. A control apparatus as defined in claim 12 which further comprises a switch for selectively switching the connection of the sample holding means and the setting means to an input side of the deviation detecting means.

14. A proportional solenoid valve control circuit for driving a proportional solenoid valve comprising:

instruction means for producing an instruction signal in accordance with an amount of manipulation of an the operating means;

discriminating means for determining a desired operating direction of the proportional solenoid valve from the instruction signal and provides a magnitude of desired direction instruction at an output thereof;

reference signal generating means for generating a predetermined reference signal;

comparison means for comparing the magnitude of desired direction instruction signal with the predetermined reference signal to develop a pulse signal having a pulse width in proportion to the amount of manipulation of the operating means; and drive means for converting the pulse signal from the comparison means into an electric current to drive the proportional solenoid valve in a direction determined by the discriminating means.

15. A control circuit as defined in claim 14 wherein the instruction means comprises a variable resistor for producing an instruction voltage signal, and the reference signal generating means comprises a triangular wave oscillation circuit for developing a triangular wave signal for comparing with the instruction voltage signal by the comparison means.

16. A control circuit as defined in claim 14 wherein the instruction signal results from a variable resistor operatively connected to the operating means and a pulse generating circuit for producing pulse signals of opposite phases, and the variable resistor is connected to a time-constant circuit for adjusting the pulse width of the pulse generating circuit.

17. A control circuit as defined in claim 14 wherein each of the instruction means and the reference signal generating means has a pulse generating circuit for producing pulse signals of opposite phases, and the comparison means compares pulse signals from the two pulse generating circuits of the instruction means and the reference signal generating means.

18. A control circuit as defined in claim 17 wherein the comparison means is an exclusive OR circuit.

* * * * *